US006634145B1

(12) United States Patent
Dolph

(10) Patent No.: US 6,634,145 B1
(45) Date of Patent: Oct. 21, 2003

(54) MODULAR STONE STAIR SYSTEM

(76) Inventor: Ormsby Dolph, 26 Quarry Rd., Ithaca, NY (US) 14850

( * ) Notice: Subject to any disclaimer, the term of this patent is extended or adjusted under 35 U.S.C. 154(b) by 59 days.

(21) Appl. No.: 10/180,242

(22) Filed: Jun. 26, 2002

(51) Int. Cl.[7] ..... E04F 11/00

(52) U.S. Cl. ..... 52/189; 52/182; 52/188; 52/191; 52/179; 52/180; 52/251; 52/604; 52/605; 52/606; 52/612; D25/62; D25/69; 249/14

(58) Field of Search ..... 52/182, 188, 189, 52/191, 251, 604, 605, 606, 612, 179, 180; D25/62, 69; 249/14

(56) References Cited

U.S. PATENT DOCUMENTS

| | | | | | |
|---|---|---|---|---|---|
| 744,887 | A | * | 11/1903 | Walsh | 52/189 |
| 1,265,949 | A | * | 5/1918 | Osborn | 52/189 |
| 1,756,351 | A | * | 4/1930 | Gentile | 52/190 |
| 1,879,996 | A | * | 9/1932 | Sherwood | 52/189 |
| 1,988,492 | A | * | 10/1935 | Henderson | 52/206 |
| 2,153,017 | A | * | 4/1939 | Henderson | 52/189 |
| 2,374,905 | A | * | 5/1945 | Wale | 52/189 |
| 2,577,864 | A | * | 12/1951 | Thornton et al. | 52/190 |
| 2,635,355 | A | * | 4/1953 | Thompson et al. | 434/195 |
| 2,672,045 | A | | 3/1954 | Alcini | 72/96 |
| 2,722,823 | A | * | 11/1955 | Summers | 52/189 |
| 2,885,883 | A | * | 5/1959 | Torricelli | 52/189 |
| 3,025,639 | A | * | 3/1962 | Lemieux | 52/189 |
| 3,311,996 | A | * | 4/1967 | Bergener | 434/207 |
| 3,343,316 | A | * | 9/1967 | McIntire | 52/190 |
| 3,706,170 | A | * | 12/1972 | Aggraves et al. | 52/189 |
| 3,845,598 | A | * | 11/1974 | Tate | 52/189 |
| 4,548,585 | A | * | 10/1985 | Kelly | 434/195 |
| 5,479,746 | A | | 1/1996 | Mannonen | 52/182 |
| 5,924,249 | A | * | 7/1999 | Kroll et al. | 52/184 |
| 6,176,049 | B1 | * | 1/2001 | Crant et al. | 52/189 |
| 6,295,772 | B1 | * | 10/2001 | Whitson | 52/182 |
| 6,374,556 | B2 | * | 4/2002 | Crant et al. | 52/182 |
| 6,428,726 | B1 | * | 8/2002 | Pribyl | 264/71 |

OTHER PUBLICATIONS

WWW.stoneyard.com (stone applications, steps and treads).*

* cited by examiner

*Primary Examiner*—Carl D. Friedman
*Assistant Examiner*—Christy Green
(74) *Attorney, Agent, or Firm*—Brown & Michaels, PC

(57) ABSTRACT

A modular stone stair system using a plurality of modules in the form of stringers, risers, treads and landings in standardized thicknesses and widths. The risers, landings (if any) and treads have different widths dependent upon the width of the stairs desired, with the treads and landing (if any) being of the full width of the stair, and the risers being a modular width such that each tread or landing is underlain by a plurality of risers. Each level of the stair has a plurality of stringers, abutting the back of the tread and riser and running to the back of the stair. The stringers vary in depth depending upon how many steps are to be present, such that each level, except the bottom, overlaps the tread and riser of the next lower level by a fixed amount. The system can easily be assembled by two people, using a shovel, a level, and a ruler, giving the homeowner or contractor the option of choosing threshold heights, widths, and landings with varying depths.

10 Claims, 8 Drawing Sheets

10

MODULAR STONE STAIR SYSTEM

BACKGROUND OF THE INVENTION

1. Field of the Invention

The invention pertains to the field of stair construction. More particularly, the invention pertains to a modular stone stair system.

2. Description of Related Art

For the purposes of terminology in describing a stair, the "tread" is the horizontal part of the stair on which a person walks. All of the treads on a given staircase are usually the same depth ("depth" meaning horizontal dimension in the direction of travel on the staircase, "width" being a horizontal dimension across the stair, orthogonal to the depth, and "height" or "thickness" being a vertical dimension, with "rise" being the vertical distance between the top of a tread and the top of the next tread). A "landing" is a deeper tread which is usually the topmost element in the stair, although it is possible to have a landing at intervals in a staircase, for design purposes. A "riser" is the vertical element which is located between one tread and the next, and a "stringer" is a piece which runs depthwise from the back of the riser toward the back of the staircase.

Stone stairs have long been used leading up to a building or home, or along paths and at retaining walls. In the past, most stone stairs were custom made of large pieces of stone, cut to fit each stair, with the tread and riser and (sometimes the stringer) typically being the same piece (known as a "heavy tread"). In some cases an entire stair might be cut from one piece of stone. The pieces used are very heavy, weighing as much as 2200 lbs., requiring multiple people and/or heavy equipment to construct the staircases. Each stone piece must be hand cut, and a mason is needed to cement the stone pieces into place and lay a full foundation.

Therefore, an easy, less expensive stone stair system is needed that can be assembled on a prepared flat surface from standardized parts without the aid of a mason, large construction crews or heavy equipment, and which is stable for repeated use.

Modular stair systems are known, in which standardized pieces are assembled into a stair. These systems are made of concrete, which allows for shapes to be molded which would be impossible to form economically from stone, which is a natural product which must be cut.

For example, U.S. Pat. No. 2,672,045, discloses a step construction comprising grooved saddles or side supports and grooved steps assembled with the riser of one step slidably overlapping the rearward portion of the tread of the next lower step. A small amount of mortar is placed in the grooves to hold the steps in the assembly together. Each tread/riser section is continuous in width across the step, and the stringer sections (called "saddles") are "L" shaped or otherwise stepped to support the outside edges of each tread/riser combination.

Another example is U.S. Pat. No. 3,343,316, which discloses "L" shaped steps, where the long side of the "L" serves as tread and the short side is a riser. Holes are drilled through the tread and the riser to lineup all the sections and keep the stairs secured to one another. This system is built on rising ground, so there are no stringers, and is intended to be made of molded concrete. Similarly, U.S. Pat. No. 3,813,831 discloses a prefabricated concrete stair system with separate treads and risers, where the riser has a shelf to hold the edge of the next lower tread, and the tread is pinned to the top of the riser. No stringers are present in this system, and the system must be laid on a sloping surface with the risers sunk in holes with dry packing.

A fourth example is U.S. Pat. No. 5,479,746, which discloses a modular staircase system using flat modules and modules with differing numbers of vertical support of which are "L", "T", "F", and "E" shaped. As in the last two stair systems, this invention needs to be laid on sloping ground.

SUMMARY OF THE INVENTION

A modular stone stair system using a plurality of modules in the form of stringers, risers, treads and landings in standardized thicknesses and widths. The risers, landings (if any) and treads have different widths dependent upon the width of the stairs desired, with the treads and landing (if any) being of the full width of the stair, and the risers being a modular width such that each tread or landing is underlain by a plurality of risers. Each level of the stair has a plurality of stringers, abutting the back of the tread and riser and running to the back of the stair. The stringers vary in depth depending upon how many steps are to be present, such that each level, except the bottom, overlaps the tread and riser of the next lower level by a fixed amount. The system can easily be assembled by two people, using a shovel, a level, and a ruler, giving the homeowner or contractor the option of choosing threshold heights, widths, and landings with varying depths.

FIGS. *7a–7i* show the stages in the method of the invention.

Figure 8:
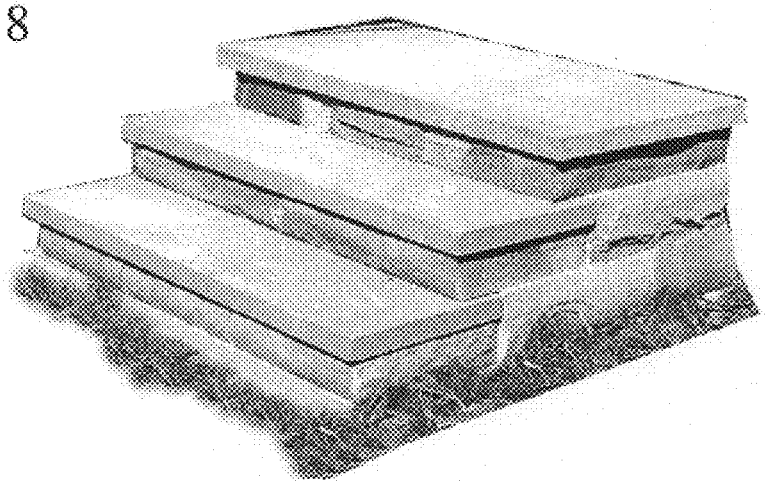

FIG. 8 shows a perspective view of the modular stairs of the invention.

DETAILED DESCRIPTION OF THE INVENTION

The present invention is a modular stone stair system that can be adapted to various buildings and homes easily, and a method of using the stair modules to make a stone stair. Each stone piece used in the system is sawn to standardized modular sizes allowing the pieces to fit together without the use of cement. The modular stone stair system gives the homeowner or contractor a wide range of sizes, preferably between 6" to 36" threshold heights, widths from 36" to 72", and landings with 12", 24", and 36" depths (it will be understood that while this specification will discuss specific dimensions as preferred, due to the particular market and type of stone used in the examples, it is not intended to restrict the invention to these particular dimensions, and other dimensions are possible within the teachings of the invention).

Figure 5:
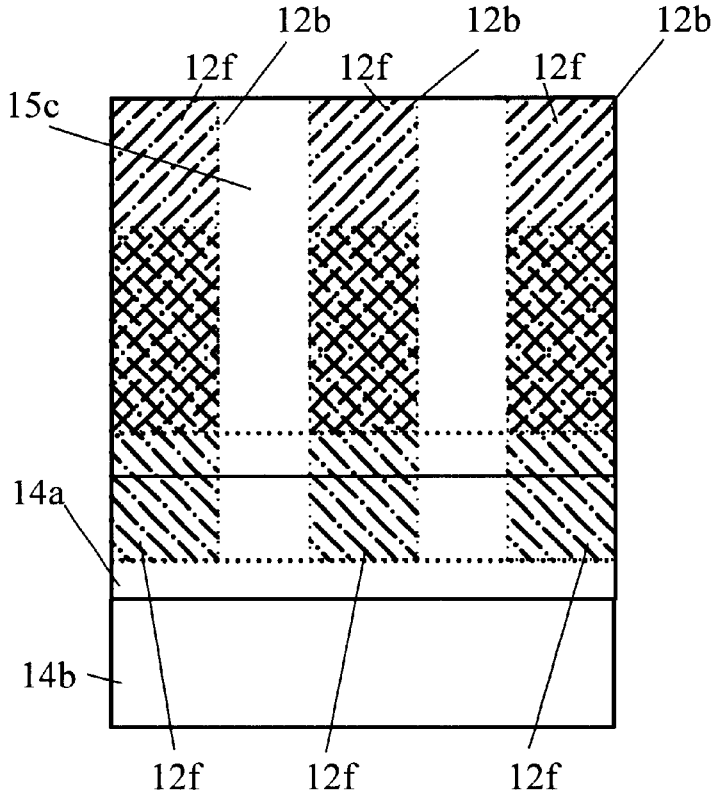
FIG. 5 shows a top view of the modular stairs of the invention.

The modular stone stair system (10) of the invention uses a plurality of modules in the form of stringers (12), risers (13), treads (14) and landings (15) in standardized thicknesses and widths. A staircase kit made up of these modules can be easily packaged and shipped as shown in FIG. 5.

Figure 4:
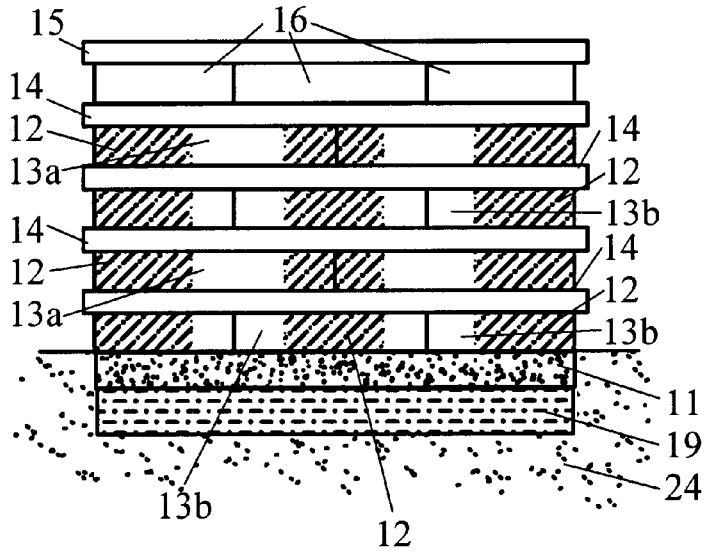
FIG. 4 shows a front view of the modular stairs of the invention.

The stringers are a standard width—preferably approximately 10". The risers (13), landings (15) and treads (14) have widths dependent upon the width of the stairs desired, preferably from 3 to 6 feet, with the treads (14) and landing (15) being of the full width of the stair, and the risers (13) being a modular width such that each tread or landing is underlain by an integral number of risers. Traditionally, as shown in FIG. 4, if there are an odd number of steps (five shown in FIG. 4), the first (lowest) step has three risers (13*b*) of one-third the width of the stair, alternating with two risers (13*a*) of one-half the width of the stair. Of course, other patterns are possible, and the risers may be slightly less in width, to provide a slight overhang if desired for decorative purposes.

The risers (13) are preferably cut with one side, to be the facing side (i.e. facing the front of the stair) in a decorative rocked (rough) surface, the two side faces flamed (flat textured), and all the other faces sawn (smooth), so as to best fit with the other pieces of the stair. The treads (14) preferably have flamed faces on top, sides and front, and the stringers (12) are preferably sawn on all sides. Of course, these distinctions are purely decorative, and the pieces can be cut as desired.

The sum of the thickness of the treads (14) (preferably 2") and the height of the risers (13) (preferably 4") are equal to the rise of the steps (preferably 6"), which is also the height of the stringers (12). The treads (14) are approximately equal in depth to the risers, or slightly less—preferably one-inch deeper than the risers (13), giving a one-inch overhang (20) on each step. Each level of the stair except the topmost has a plurality of stringers (12)—preferably three stringers as shown in dashed fill in FIGS. 4 and 5, with one on each outside edge of the stair, and one in the middle, abutting the back of the tread and riser and running to the back of the stair.

Figure 1:
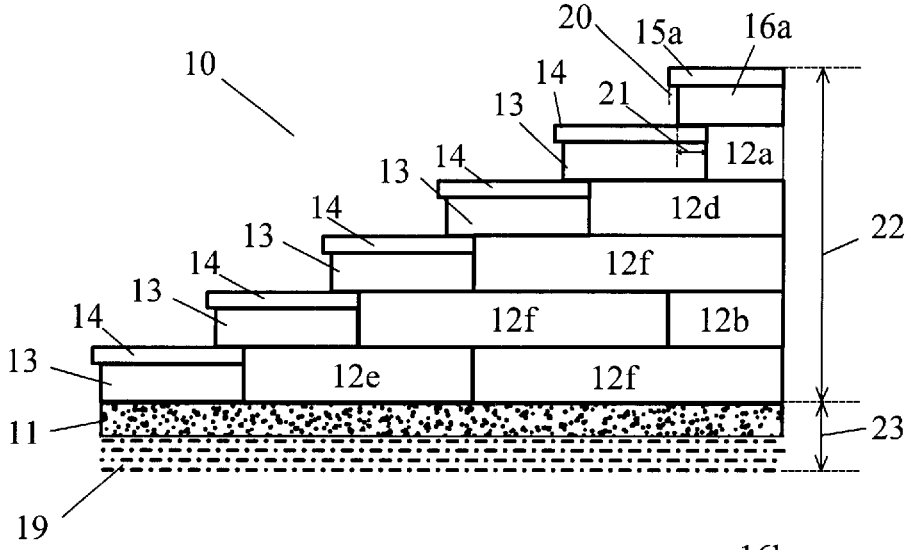
FIG. 1 shows a side view of the modular stairs of the invention featuring a 12" landing.
Figure 2:
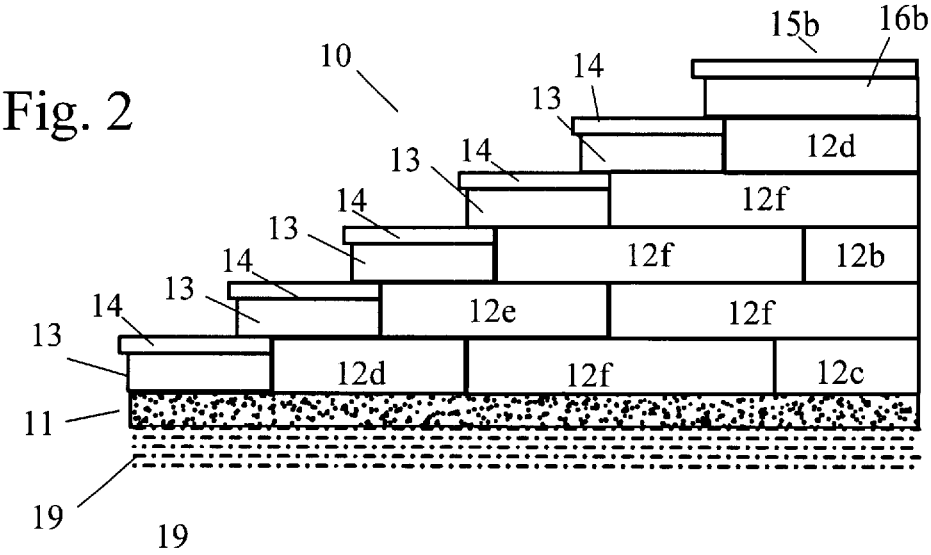
FIG. 2 shows a side view of the modular stairs of the invention featuring a 24" landing.
Figure 3:
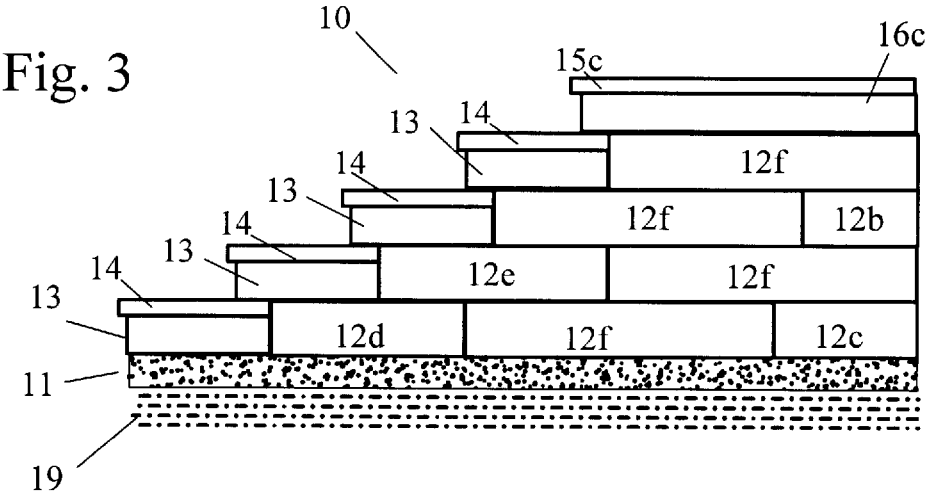
FIG. 3 shows a side view of the modular stairs of the invention featuring a 35" landing.

The stringers (12) vary in depth depending upon how many steps are to be present, such that each level, except the bottom, overlaps the tread and riser of the next lower level by a fixed amount (21), as can be seen in FIGS. 1 through 3. The topmost step is a landing (15) with a landing riser (16), which is of standard riser height but increased depth (preferably, one inch less in depth than the landing).

The modular stone stair of the invention is preferably laid on a concrete slab (11) of four inches thickness, which in turn is poured over a gravel bed (19) of four inches thickness, set into an 8" deep (23) hole in the ground (24).

The stairs can be constructed using the modular stone pieces in varying widths and heights. FIGS. 1, 2, and 3 through 5, show stairs having 12", 24" and 35" landings, respectively, a width of four feet, and a threshold height (22) of 36" in FIGS. 1 and 2, and 30" in FIGS. 3 and 4. In each of the FIGS. 1 to 3 (and FIG. 4, which is a front view of the stair of FIG. 4), which are to be taken as examples and not limiting, the dimensions of the modules are as follows:

| Element | Height | Width | Depth |
|---|---|---|---|
| Stringer (12a) (FIG. 1 only) | 6" | 10" | 8" |
| Stringer (12b) | 6" | 10" | 11" |
| Stringer (12c) (FIGS. 2 and 3 only) | 6" | 10" | 14" |
| Stringer (12d) | 6" | 10" | 19" |

-continued

| Element | Height | Width | Depth |
|---|---|---|---|
| Stringer (12e) | 6" | 10" | 22" |
| Stringer (12f) | 6" | 10" | 30" |
| Risers (13) (see FIG. 4 for 13a, 13b) | 4" | 23" (13a)<br>15.3" (13b) | 15" |
| Treads (14) | 2" | 48" | 16" |
| FIG. 1: | | | |
| Landing (15a) | 2" | 48" | 12" |
| Landing Riser (16a) | 4" | 47" | 11" |
| FIG. 2: | | | |
| Landing (15b) | 2" | 48" | 24" |
| Landing Riser (16b) | 4" | 47" | 23" |
| FIG. 3: | | | |
| Landing (15c) | 2" | 48" | 35" |
| Landing Riser (16c) | 4" | 47" | 34" |

The modular stone stair system can be installed by two people using a shovel, a level, and ruler. The stairs are built from the ground up using the following method of the invention.

Figure 7A:
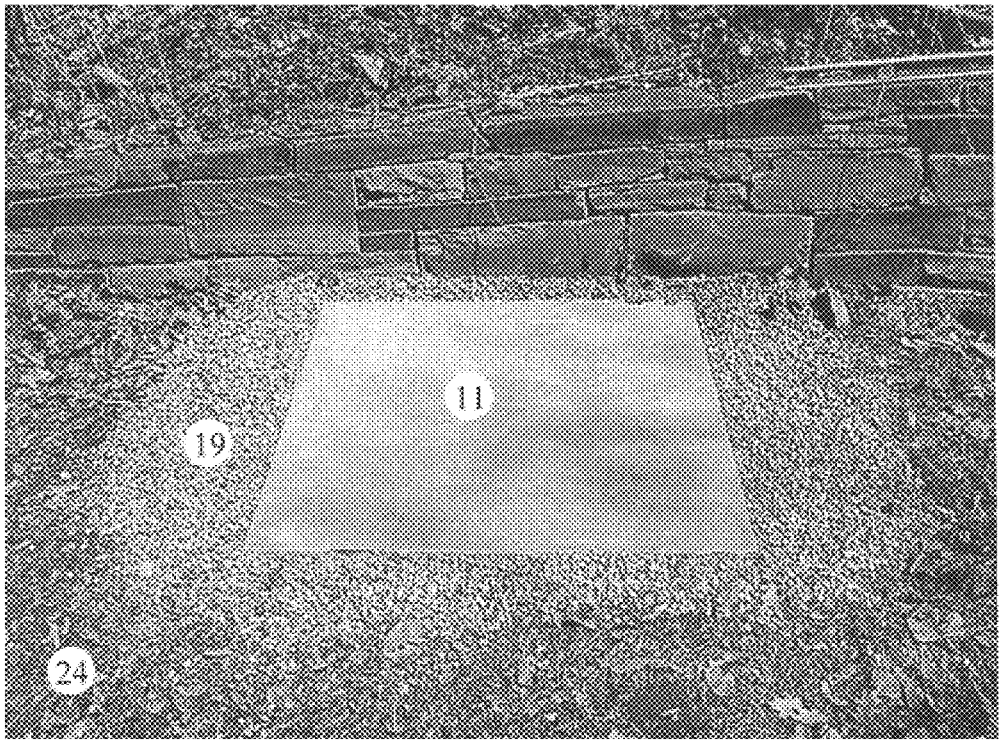

Step 1 (FIG. 7*a*): The first step in assembling the modular stone stairs is to excavate the soil 8", where the stairs are going to sit. After the soil has been removed, the hole is filled with #2 gravel 4" below the first rise. Then a 4" thick concrete pad (11) the size of the footprint of the stairs is poured.

Figure 7B:
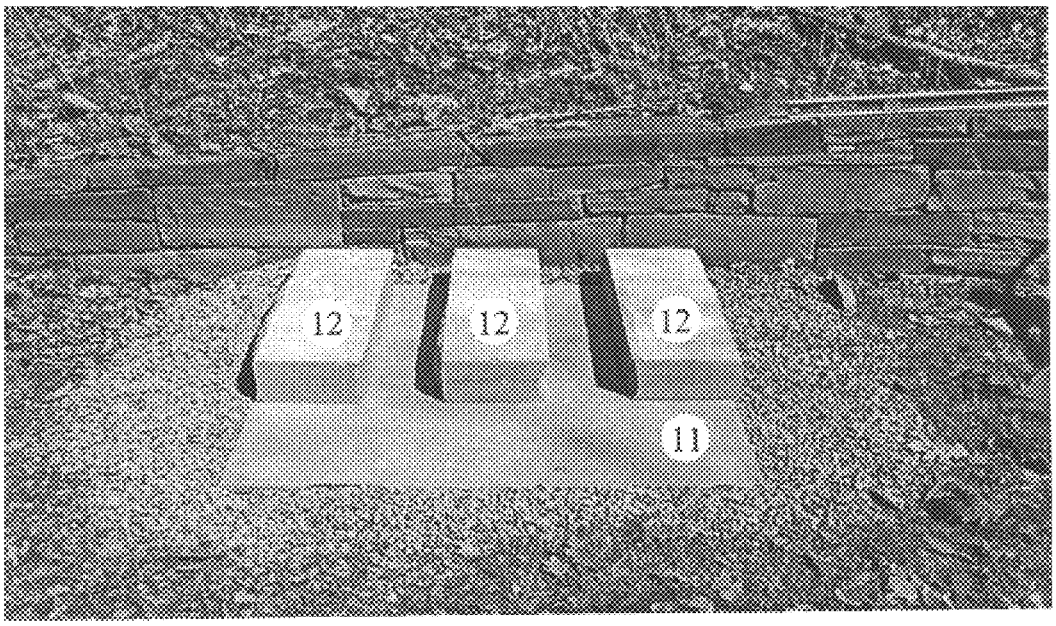

Step 2 (FIG. 7*b*): Place three spaced apart sets of stringers (12) against the house or lined up with the back of the pad (11). The number and size of the modular stringers laid down varies, and is dependent on the number of stairs to be present as well as the landing size chosen, as has previously been seen in FIGS. 1–3. For example, if a 36" high stair with a 12" landing were being constructed, as shown in FIG. 1, the first layer of stair constructing on top of the pad (11) would consist of two sets of three stringers, one 30" deep set (12*f*) lined up with the back of the pad (11), and a set of 22" deep stringers (12*e*) in front of, and aligned with, the other set. Similarly, as shown in the 30" high stair with 35" landing of FIG. 3, three sets of stringers would be laid down, having depths of 14" (12*c*), 30" (12*f*) and 19" (12*d*), from back to front. Other depths are possible using the modular stringer sizes.

Figure 7C:
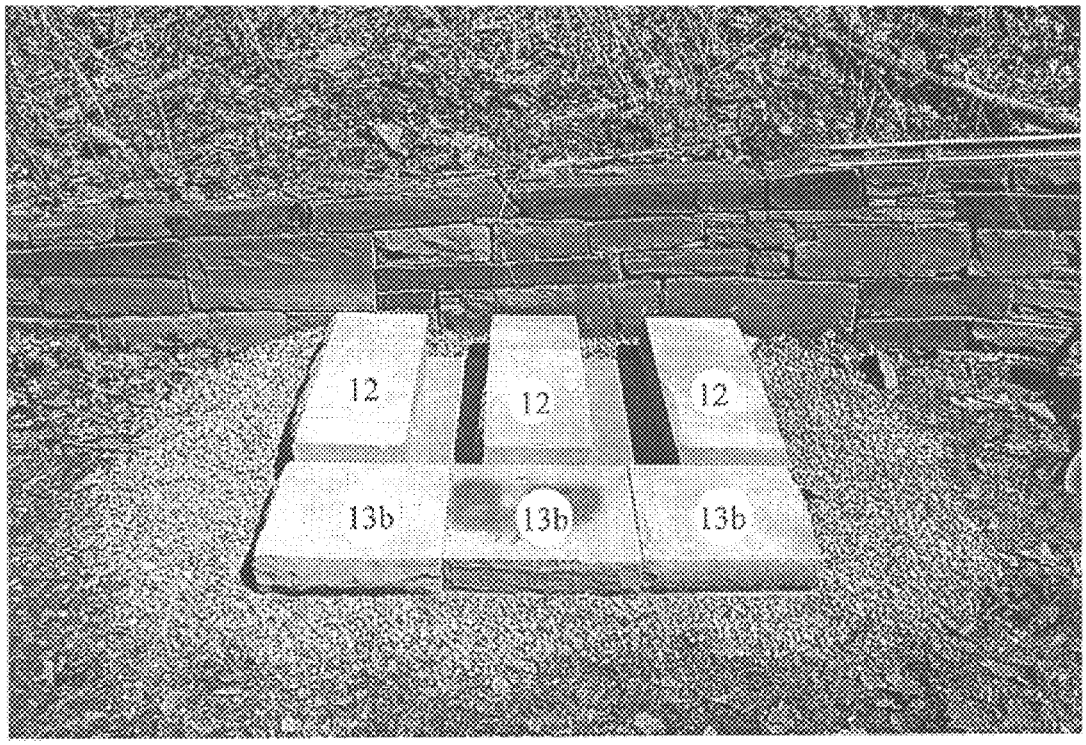

Step 3 (FIG. 7*c*): Place the risers (13) in front of the stringers (12). The risers (13) are always placed such that the rocked edge faces front and the sawed edges face out, as shown in FIG. 7*c*. If there is to be an even number of rises, then two longer risers (13*a*) are placed before the stringers (12). If there is an odd number of rises, then three shorter risers (13*b*) are placed before the stringers (12).

Figure 7D:
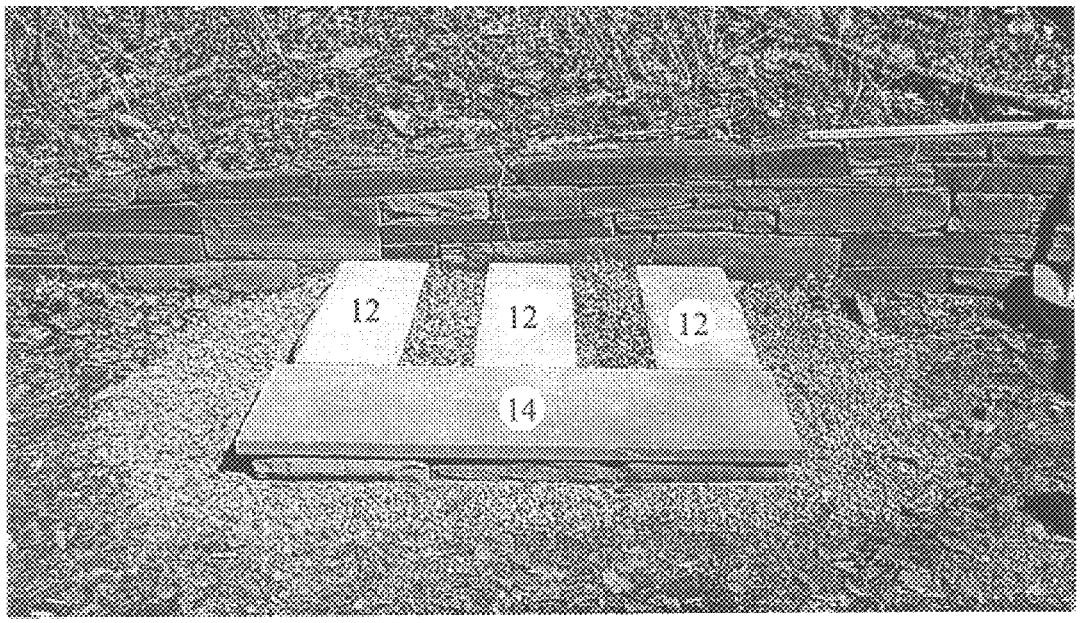

Step 4 (FIG. 7*d*): Place tread (14) onto the risers (13) butted up to the back of the stringers (12). The flamed faces of the tread (14) should be exposed on the top, sides, and front. The voids between the stringers (12) is preferably filled in with gravel.

Figure 7E:
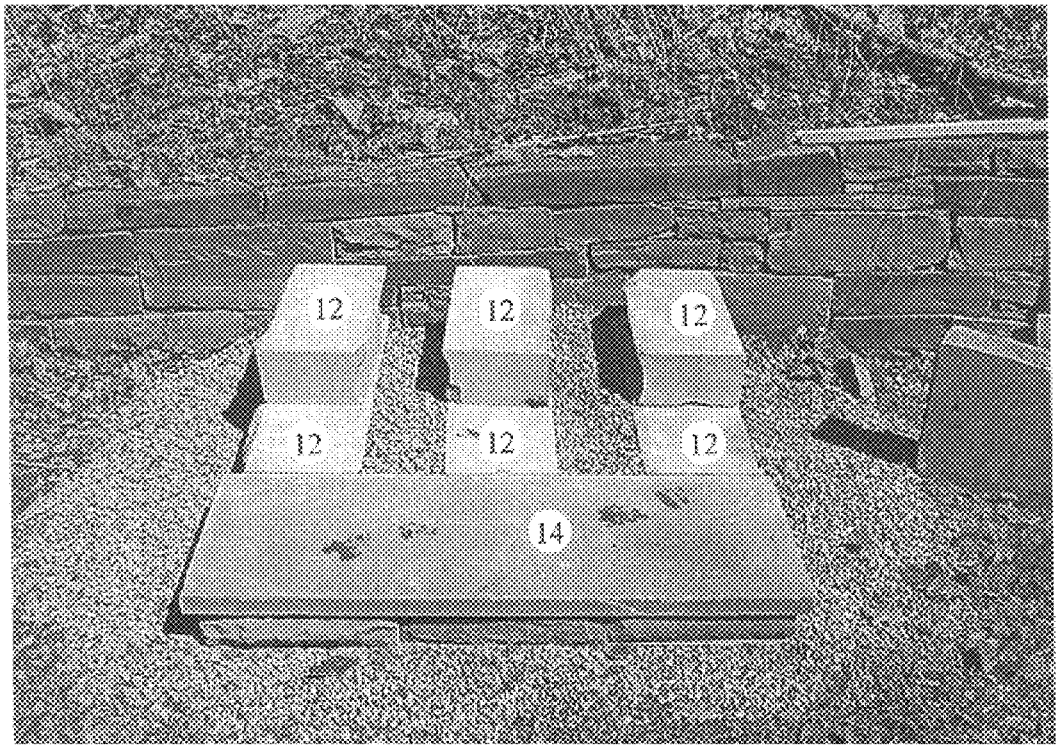
Figure 7F:
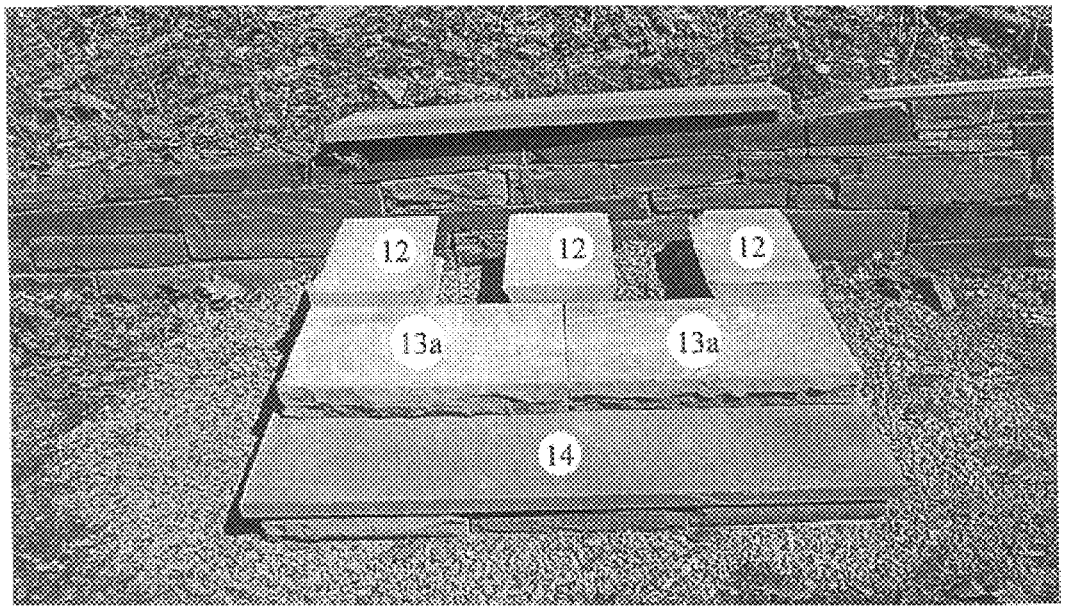
Figure 7G:
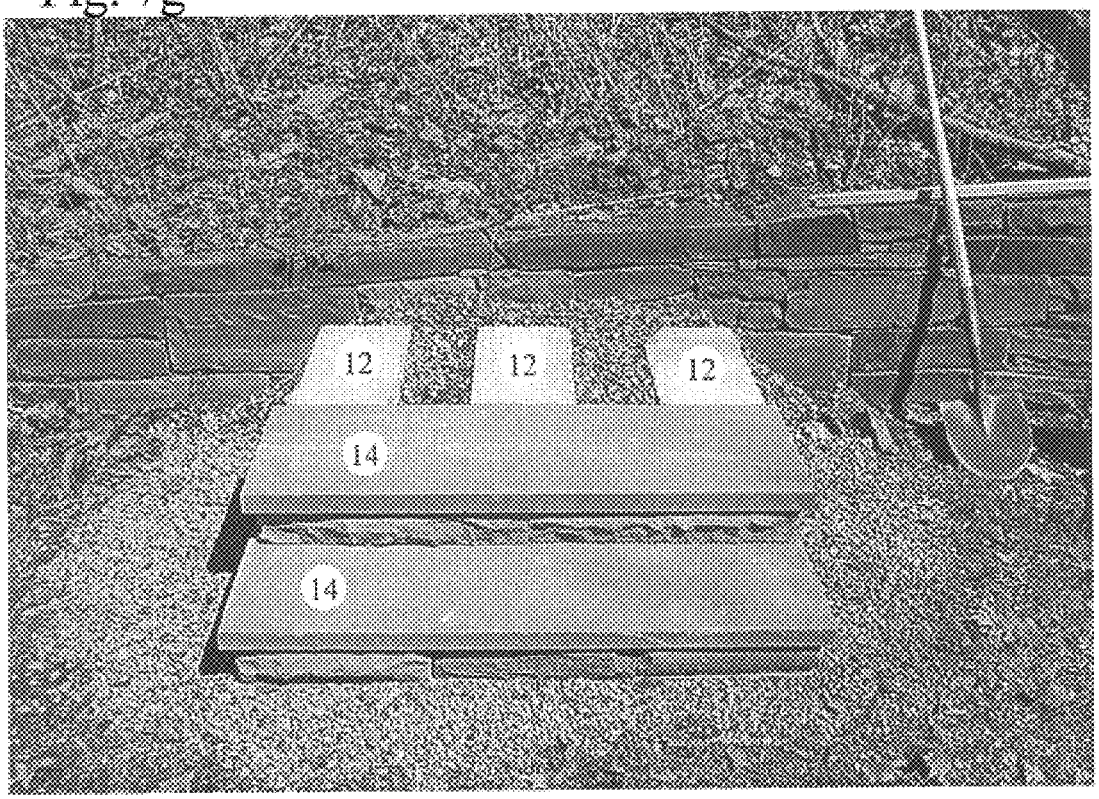
Figure 7H:
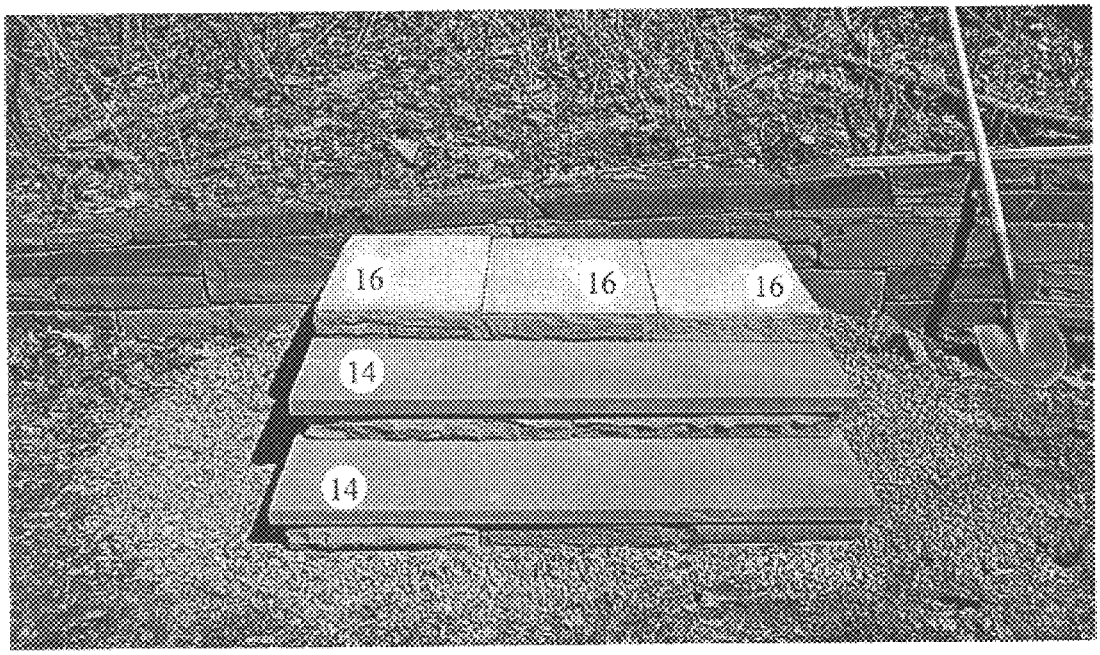

Steps 2 (FIG. 7*e*), 3 (FIG. 7*f*) and 4 (FIG. 7*g*) are then repeated for each succeeding step. The number of risers is alternated between three (13*b*) and two (13*a*). The stringers are chosen as shown in FIGS. 1–3, or as needed, to match the depth of each rise, until the last step before the landing (top of the stair) is complete.

Figure 6:
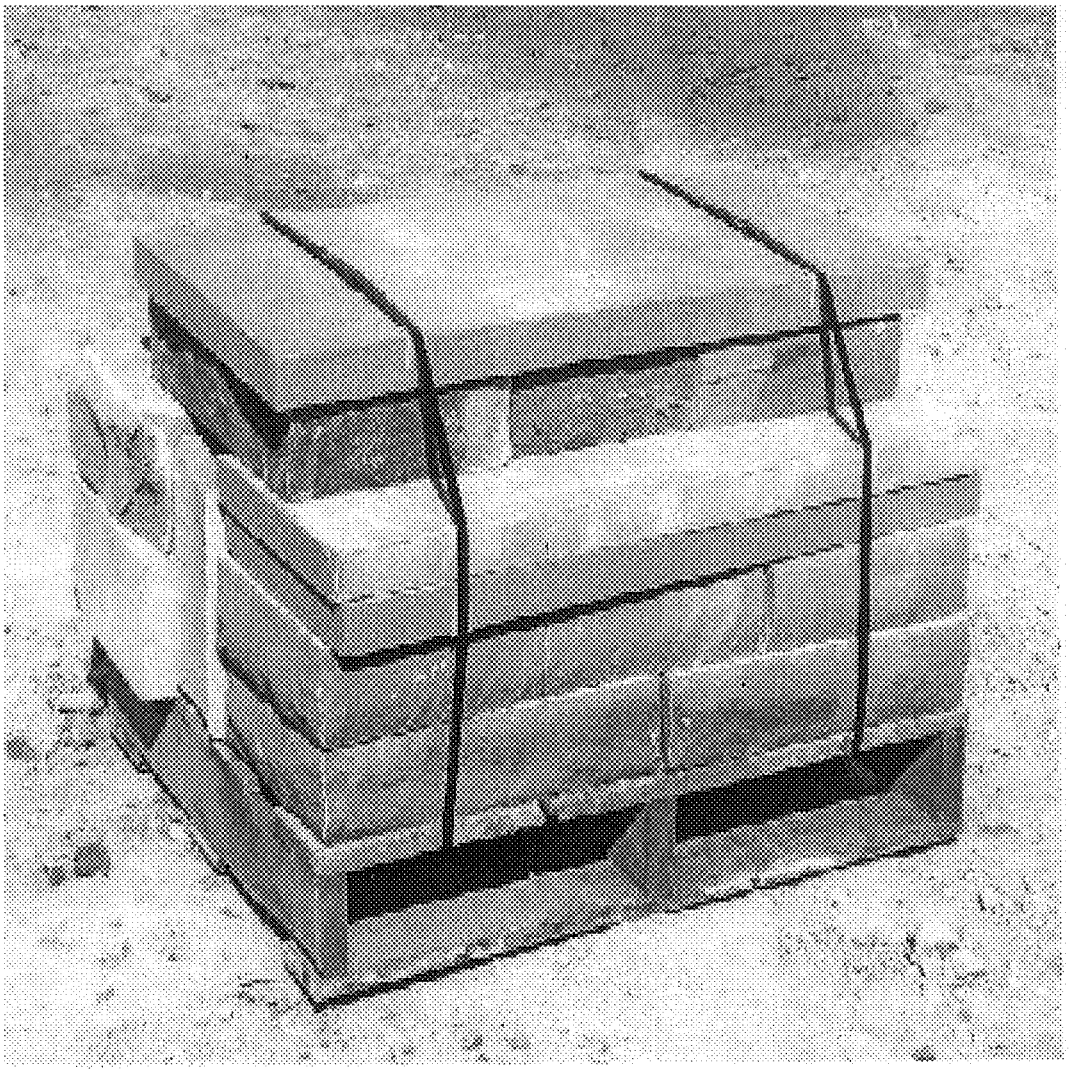
FIG. 6 shows a modular stair kit of the invention.

Step 5 (FIG. 6*h*): Set the landing risers (16).

Figure 7I:
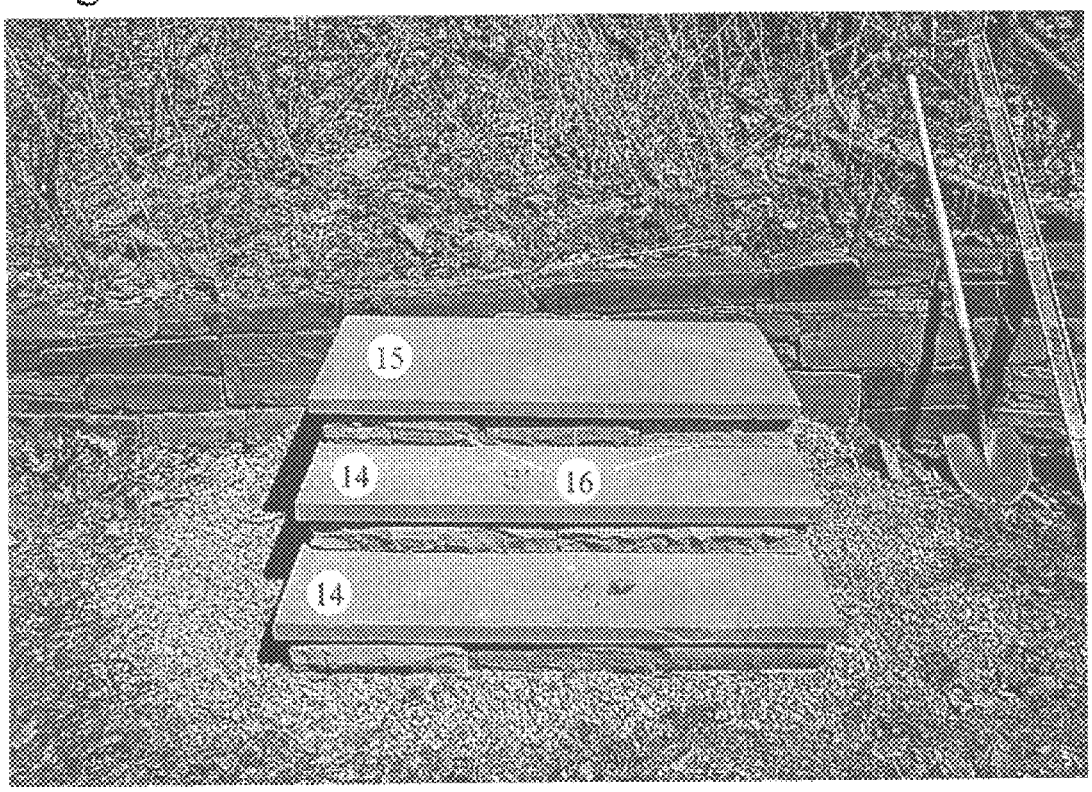

Step 6 (FIG. 7*i*): Place the landing (15) on top of the landing risers (16).

FIG. 7 shows a perspective view of the assembled modular stone stair system.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of constructing a modular stone stair having a plurality of steps, a width, a depth and a height, using a plurality of stone stair modules, the modules comprising stringers, treads, and risers, each module having a width, a depth and a thickness, the thickness of the stringers being equal to a sum of the thicknesses of a tread and a riser, the plurality of stringers having a plurality of modular lengths, the treads having a width equal to the width of the stair, the risers having a plurality of widths such that the width of a set of an integral number of risers is approximately equal to the width of the stair, and the depth of a riser is approximately equal to or slightly less than the depth of a tread, the method comprising the steps of:

a) placing three parallel spaced apart sets of stringers lined up with the back of the stair, each set comprising at least one stringer, the stringers in the set being chosen to have a total depth equal to the depth of the stair less the depth of a riser;

b) placing a plurality of risers in front of the stringers, the plurality of risers having a combined width approximately equal to the width of the stair;

c) placing a tread onto the risers, adjacent to the stringers; and d) repeating steps a) through c), with the total depth of the stringers being reduced in each step by an amount equal to a desired overlap, until a desired number of stairs have been assembled.

2. The method of claim 1, further comprising the step, before step (a) of preparing a foundation by the steps of:

digging a hole having horizontal dimensions at least equal to a footprint of the stair to be constructed;

spreading a layer of gravel in the hole;

pouring a level pad on top of the gravel.

3. The method of claim 1, in which in addition to the tread, riser and stringer modules, the stair has a landing module and a plurality of landing riser modules, the landing module having a thickness equal to the thickness of a tread, a width equal to the width of the stair, and a depth chosen to provide a top landing for the stair, the landing riser modules having a thickness equal to the thickness of a riser module, a width chosen such that the width of a set of an integral number of landing risers is approximately equal to the width of the stair, and a depth approximately equal to the depth of the landing module, and the method further comprises the step, after step (d), of:

e) placing a plurality of landing risers top of the tread and stringers of the last step placed, the plurality of landing risers having a combined width approximately equal to the width of the stair; and c) placing a landing onto the landing risers, forming the top landing of the stair.

4. The method of claim 1, in which the desired overlap is approximately one-third of the depth of a tread.

5. The method of claim 1, further comprising the step of spreading a bead of caulking between the risers and treads.

6. The method of claim 1, further comprising the step of filling spaces between the stringers with gravel.

7. A modular stone stair having a plurality of steps, a width, a depth and a height, comprising:

a plurality of stone stair modules, the modules comprising stringers, treads, and risers, each module having a width, a depth and a thickness, the thickness of the stringers being equal to a sum of the thicknesses of a tread and a riser, the plurality of stringers having a plurality of modular lengths, the treads having a width equal to the width of the stair, the risers having a plurality of widths such that the width of a set of an integral number of risers is approximately equal to the width of the stair, and the depth of a riser being approximately equal to or slightly less than the depth of a tread.

8. The modular stone stair of claim 7, further comprising a landing module and a plurality of landing riser modules, the landing module having a thickness equal to the thickness of a tread, a width equal to the width of the stair, and a depth chosen to provide a top landing for the stair, the landing riser modules having a thickness equal to the thickness of a riser module, a width chosen such that the width of a set of an integral number of landing risers is approximately equal to the width of the stair, and a depth approximately equal to the depth of the landing module.

9. A kit for constructing a stone stair having a plurality of steps, a width, a depth and a height, comprising:

a plurality of stone stair modules, the modules comprising stringers, treads, and risers, each module having a width, a depth and a thickness, the thickness of the stringers being equal to a sum of the thicknesses of a tread and a riser, the plurality of stringers having a plurality of modular lengths, the treads having a width equal to the width of the stair, the risers having a plurality of widths such that the width of a set of an integral number of risers is approximately equal to the width of the stair, and the depth of a riser being approximately equal to or slightly less than the depth of a tread;

the plurality of modules being chosen such that the modules in the kit can be assembled into a stair of chosen width, depth and height.

10. The kit of claim 9, further comprising a landing module and a plurality of landing riser modules, the landing module having a thickness equal to the thickness of a tread, a width equal to the width of the stair, and a depth chosen to provide a top landing for the stair, the landing riser modules having a thickness equal to the thickness of a riser module, a width chosen such that the width of a set of an integral number of landing risers is approximately equal to the width of the stair, and a depth approximately equal to the depth of the landing module.

* * * * *